US009033104B1

(12) United States Patent
Calloway

(10) Patent No.: US 9,033,104 B1
(45) Date of Patent: May 19, 2015

(54) STABILIZER SUPPORT FOR EXTENSION LADDER

(71) Applicant: James A. Calloway, Lowell, IN (US)

(72) Inventor: James A. Calloway, Lowell, IN (US)

( * ) Notice: Subject to any disclaimer, the term of this patent is extended or adjusted under 35 U.S.C. 154(b) by 0 days.

(21) Appl. No.: 14/282,962

(22) Filed: May 20, 2014

(51) Int. Cl.
*E06C 7/42* (2006.01)

(52) U.S. Cl.
CPC .. *E06C 7/423* (2013.01); *E06C 7/42* (2013.01)

(58) Field of Classification Search
CPC ..... E06C 7/42; E06C 7/423
See application file for complete search history.

(56) References Cited

U.S. PATENT DOCUMENTS 1,521,814 A * 1/1925 Houska ..... 182/165
3,878,917 A 4/1975 McBride
4,147,231 A 4/1979 Chantler et al.
4,565,262 A * 1/1986 Hawkins ..... 182/116
4,723,629 A 2/1988 Vanden Hoek et al.
6,959,785 B1 * 11/2005 Chilton ..... 182/107

FOREIGN PATENT DOCUMENTS

CS CH 316680 A * 10/1956
DE 423515 C * 1/1926
FR 1205670 A * 2/1960

* cited by examiner

*Primary Examiner* — Alvin Chin-Shue
(74) *Attorney, Agent, or Firm* — Crossley Patent Law

(57) ABSTRACT

A stabilizer support for extension ladder having a pair of frame members. A pair of spring loaded telescoping extension legs, one of each disposed within each of the frame members. A plurality of adjustment mechanisms and hinges. A pair of adjustment feet having non-skid frictional engagement surfaces. Each of the adjustment feet configured to rotate about an axis of one of the hinges. A lateral support member disposed upon and longitudinally traversing between an inner wall of each frame member. The support member having a medially disposed pivot. A spring loaded adjustable rung support disposed upon the pivot. A pair of mounting plates disposed on an upper end of each of the frame members. A hinging surface configured to angularly adjust within a slit of the upper end. A mounting surface configured to engage a mounting member of a ladder.

8 Claims, 5 Drawing Sheets

STABILIZER SUPPORT FOR EXTENSION LADDER

BACKGROUND OF THE INVENTION

Various types of stabilizer supports for extension ladders are known in the prior art. These stabilizer supports normally support ladders from the left and right sides, respectively, keeping the ladder from becoming destabilized and falling in either side direction, but fail to keep the ladder stabilized in a frontward orientation. Further, the prior art fails to have a rung support member that directly engages a rung of a ladder from the front end, redistributing a weight upon the ladder, reinforcing the ladder increasing its load bearing capacity, and stabilizing the ladder in a vertical or frontwardly angular position.

Thus, what is needed is a stabilizer support for extension ladders that frontwardly engages an extension ladder and has a rung support that engages a rung of a ladder from the front end, redistributing a weight upon the ladder, reinforcing the ladder increasing its load bearing capacity, and stabilizing the ladder in a vertical or frontwardly angular position.

FIELD OF THE INVENTION

The present invention relates to a stabilizer support for ladders, and more particularly, to a stabilizer support for extension ladders that frontwardly engages the extension ladder and includes a rung support that engages a rung of a ladder, redistributing a weight upon the ladder, reinforcing the ladder increasing its load bearing capacity, and stabilizing the ladder in a vertical or frontwardly angular position.

SUMMARY OF THE INVENTION

The general purpose of the present stabilizer support for extension ladder, described subsequently in greater detail, is to provide a stabilizer support for extension ladder which has many novel features that result in a stabilizer support for extension ladder which is not anticipated, rendered obvious, suggested, or even implied by prior art, either alone or in combination thereof.

The stabilizer support for extension ladder includes a mirror image pair of hollow spring loaded parallel frame members. Each respective frame members has an upper end, a lower end, and an inner wall. A slit is disposed upon the upper end of each frame member.

A lateral support member is medially disposed upon and longitudinally traversing between the inner wall of each respective frame member and is perpendicular to each frame member. A pivot is medially disposed upon the lateral support member and is configured to rotate about a longitudinal axis of the lateral support member.

The present stabilizer support for extension ladder also includes a spring loaded adjustable rung support having a hollow cylinder and a telescoping cylindrical extension member. The telescoping cylindrical extension member is medially disposed upon the pivot. The cylindrical extension member is telescopingly disposed within and engaged with the hollow cylinder. The hollow cylinder has a proximal end and a distal end. The rung support is configured to extend upon an adjustment of the cylindrical extension member within the hollow cylinder. Multiple pivots supporting multiple spring loaded adjustable rung supports are envisioned to be within the spirit and scope of the invention as they would have a similar function, operate in the same way, and yield a similar result.

The present stabilizer support for extension ladder also includes a plurality of adjustment mechanisms. Each of the plurality of adjustment mechanisms have a welded nut and a threaded member. Each of the threaded members are configured to frictionally engage one of the of welded nuts. A skilled artisan would appreciate that other adjustment mechanisms are envisioned to be within the spirit and scope of the invention as they would have a similar function, operate in the same way, and yield a similar result. Other adjustment mechanisms include but are not limited to spring loaded rod and aperture mechanisms, clamp mechanisms, and ratchet type mechanisms.

One of the plurality of adjustment mechanisms is disposed upon the proximal end of the hollow cylinder. The said adjustment mechanism that is disposed upon the proximal end of the hollow cylinder is configured to reversibly secure the adjustment of the cylindrical extension member within the hollow cylinder. A generally C-shaped rung engagement member is disposed upon the distal end of the hollow cylinder. The rung engagement member is configured to frictionally fixedly engage a rung of a ladder.

The present stabilizer support for extension ladder also includes a plurality of hinges. Each of the hinges are configured to rotate about an axis, allowing for the angular adjustment of any component disposed upon the hinge. The apparatus also includes a mirror image pair of load bearing telescoping extension legs having a first extension leg and a second extension leg. Each respective extension leg has a bottom end. One of the plurality of hinges is disposed upon the bottom end of each of the extension legs. Each respective extension leg is slidingly engaged with one of the parallel frame members respectively, and is configured to adjust therein.

Additionally, at least one of the plurality of adjustment mechanisms is disposed upon each of the respective frame members. Each of the said adjustment mechanisms that are disposed upon each of the frame members are configured to reversibly secure the adjustment of the respective extension leg within one of the respective frame members.

The present stabilizer support for extension ladder also includes a mirror image pair of adjustment. Each of the respective adjustment feet are disposed upon one of the respective hinges of the bottom end of one of each of the extension legs. Each of the adjustment feet is configured to angularly adjust about one of the hinges. Additionally, each adjustment foot has a non-skid frictional engagement surface that is configured to maintain the respective adjustment foot in frictional alignment upon a surface.

The apparatus further includes a mirror image pair of mounting plates. Each of the respective mounting plates have a mounting surface and a hinging surface. One of the plurality of hinges is disposed upon the upper end of each of the frame members. The hinging surface of each of the respective mounting plates is disposed upon one of the respective hinges of the upper end of one of each of the frame members. The hinging surface of each of the mounting plates is configured to angularly adjust within the slit of the upper end of each of the respective frame members. Therefore, the hinging surface has a width less than that of the slit, and the hinging surface has a length sufficient enough to allow each of the mounting plates to adjust to an angle wherein the mounting surface is at least parallel with the pair of frame members.

At least one aperture is disposed upon the mounting surface of each of the mounting plates. Each of the at least one aperture is configured to reversibly secure a threaded member therethrough. Wherein, each of the mounting plates can be secured to a mounting surface of a ladder by aligning the respective mounting plate with the mounting surface of the ladder, threading a threaded member through the apertures of each one of the mounting plates and the mounting surface, and securing the threaded member with a bolt.

A plurality of reinforcement baffles are disposed within each of the telescoping extension legs. The reinforcement baffles are configured to reinforce the load bearing telescoping extension legs and evenly distribute a weight upon the telescoping extension legs. Each of the spring loaded frame members are configured to bias each of the telescoping extension legs in an extended position, the length of which is determined by the users adjustment of one of the adjustment mechanism. The reinforcement baffles prevent the extension legs from buckling under the pressure of the weight of the ladder and a user upon the extension legs.

Thus has been broadly outlined the more important features of the present stabilizer support for extension ladder so that the detailed description thereof that follows may be better understood and in order that the present contribution to the art may be better appreciated.

Numerous objects, features and advantages of the present stabilizer support for extension ladder will be readily apparent to those of ordinary skill in the art upon reading the following detailed description of presently preferred, but nonetheless illustrative, examples of the present stabilizer support for extension ladder when taken in conjunction with the accompanying drawings.

BRIEF DESCRIPTION OF THE DRAWINGS

Figures

DETAILED DESCRIPTION OF THE DRAWINGS

Figure 1:
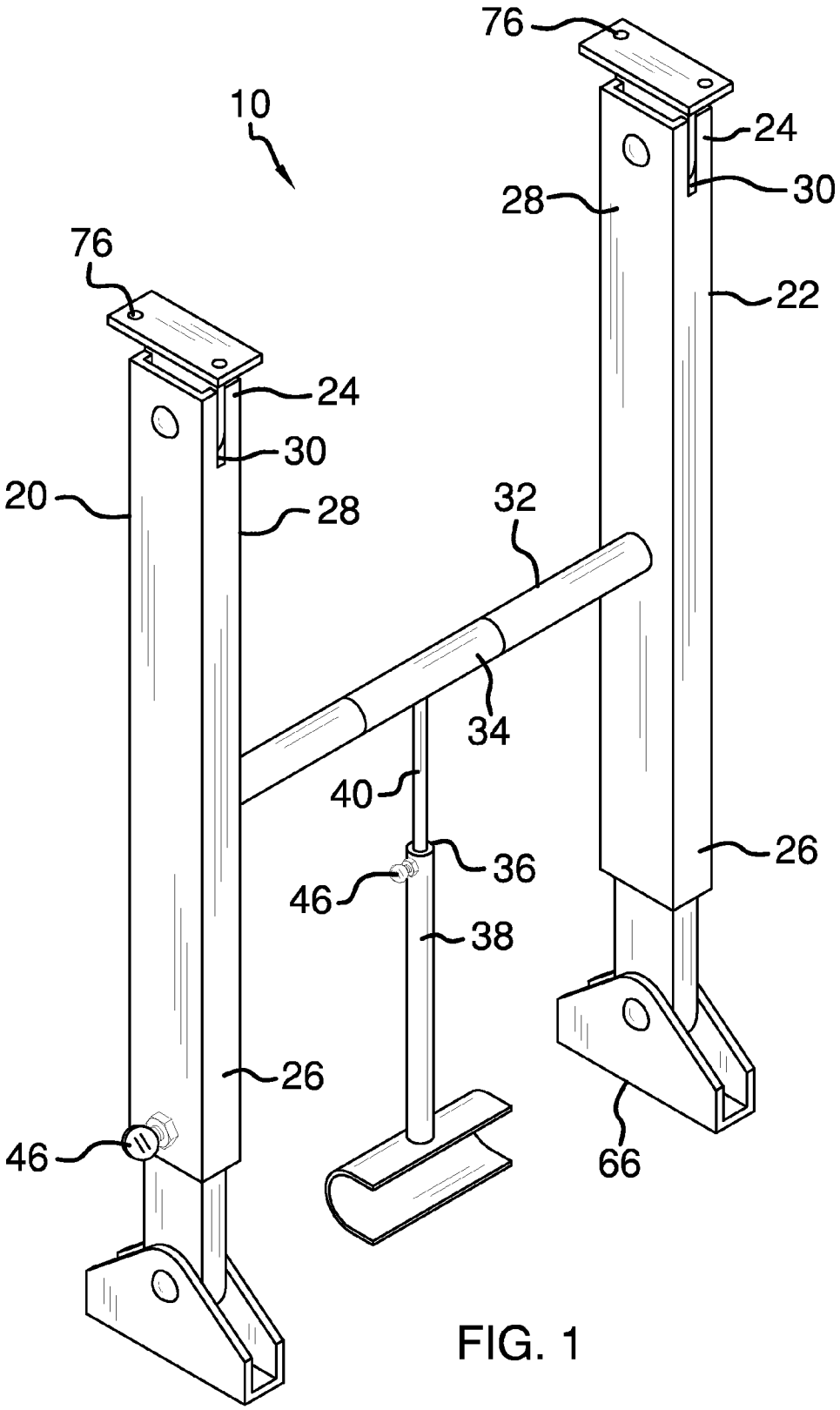
FIG. 1 is an isometric view.
Figure 2:
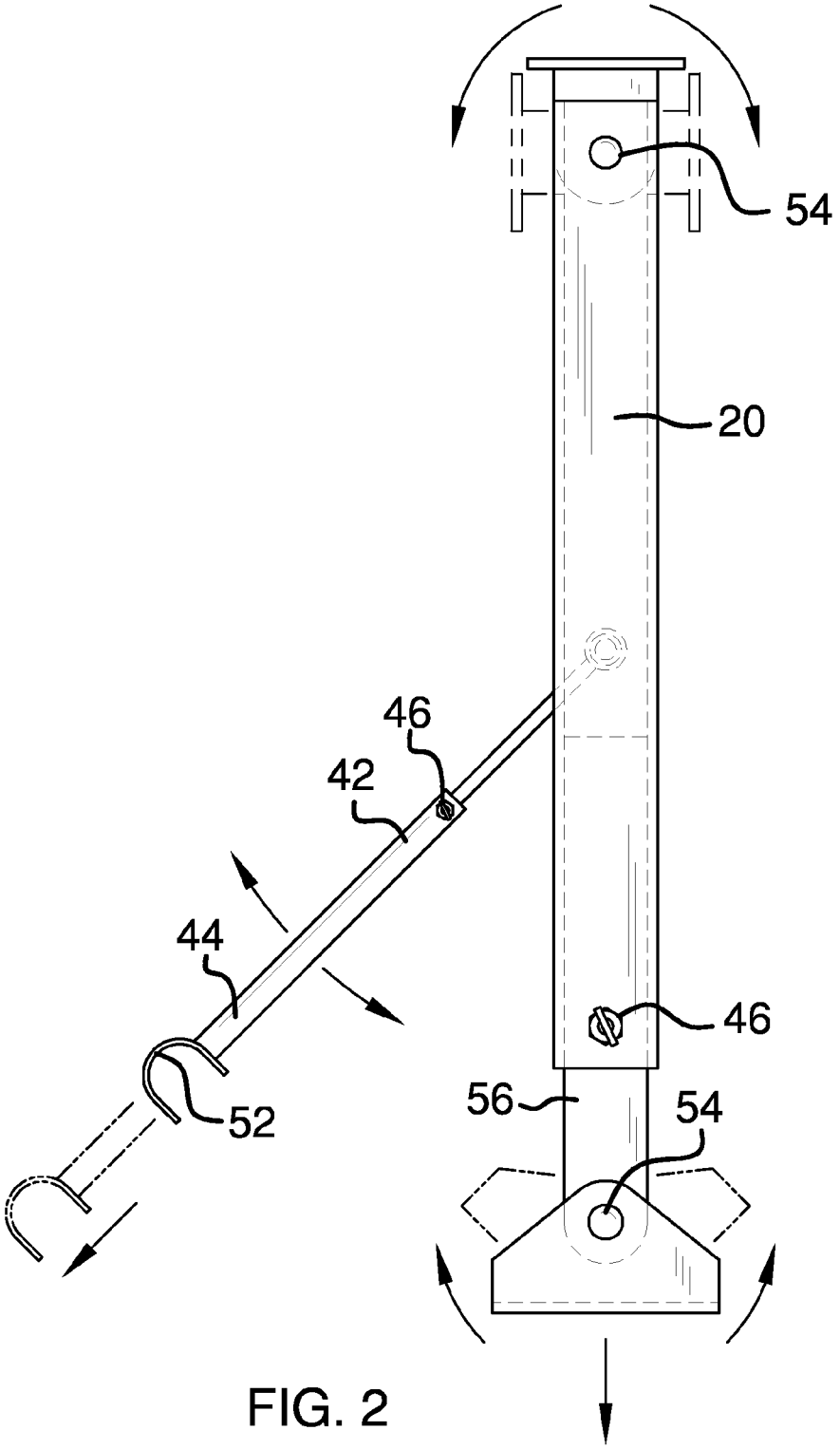
FIG. 2 is a side view.
Figure 3:
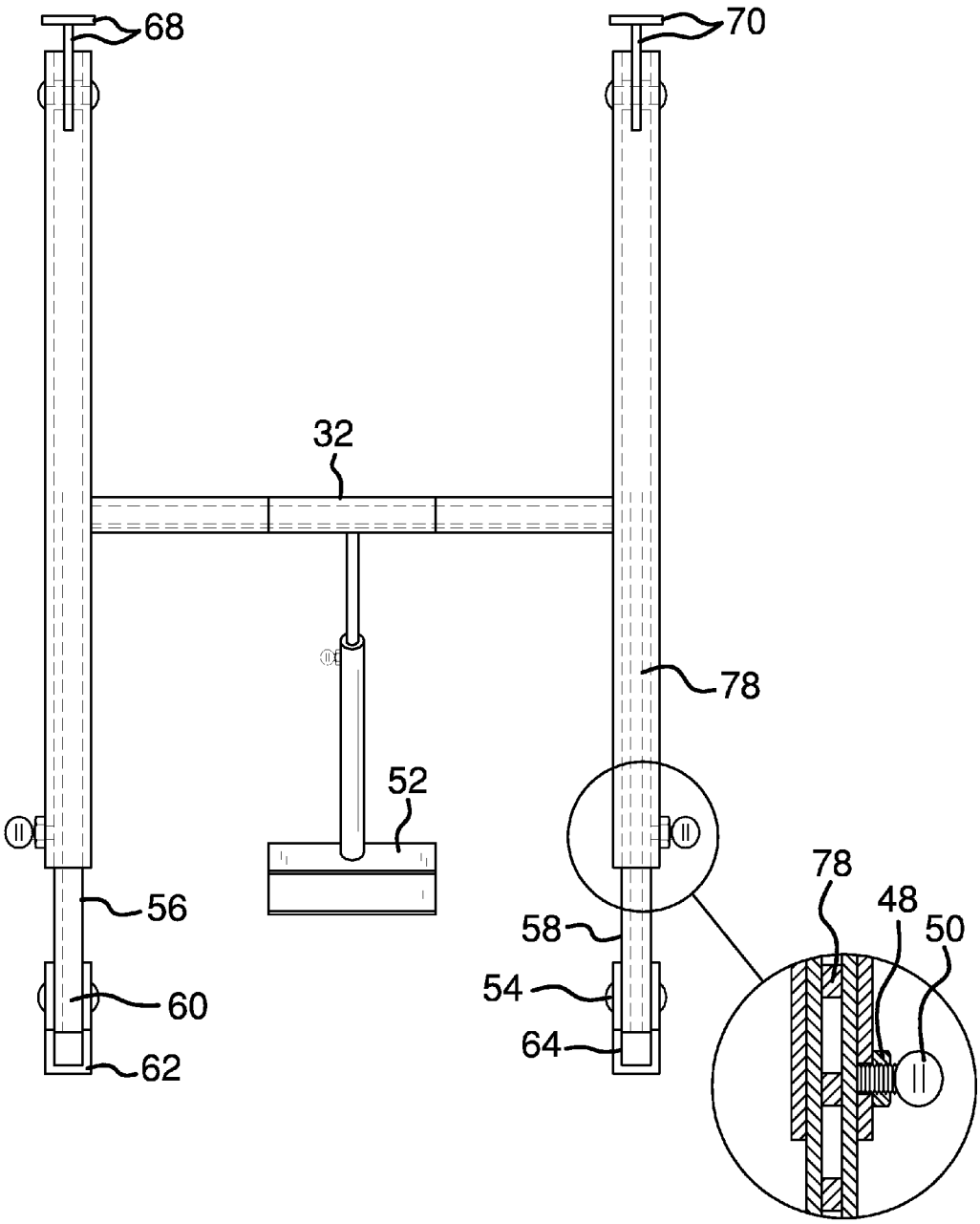
FIG. 3 is a front view.
Figure 4:
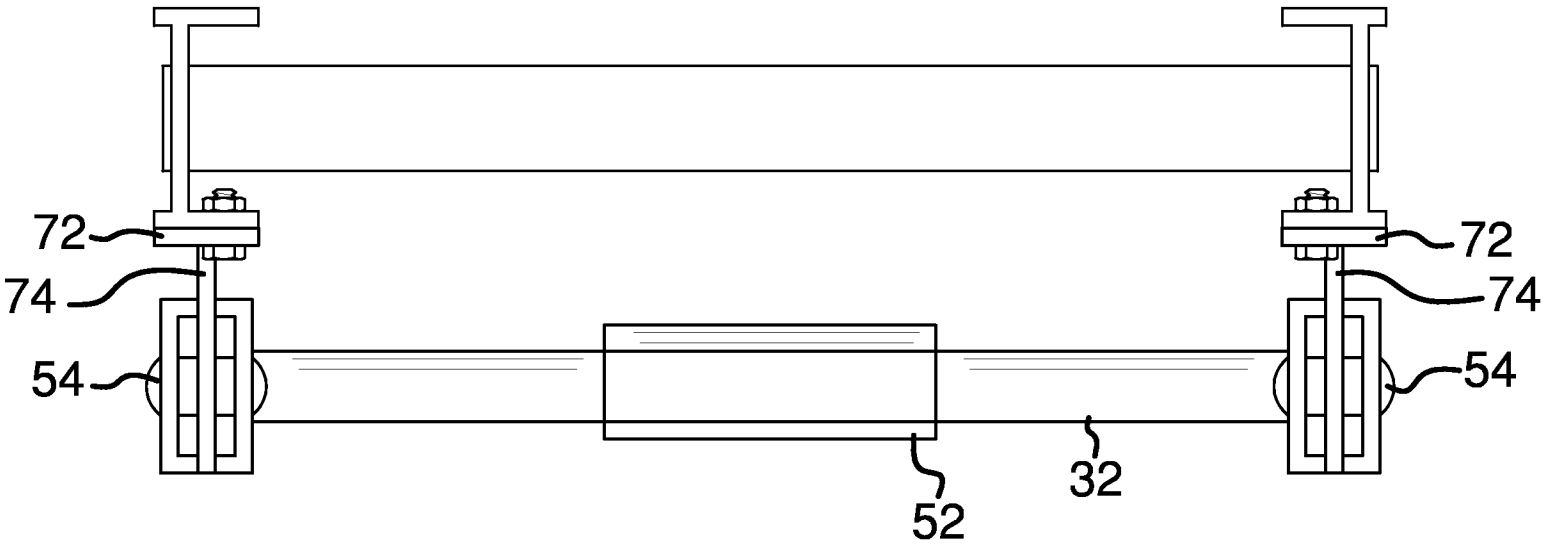
FIG. 4 is a top view.
Figure 5:
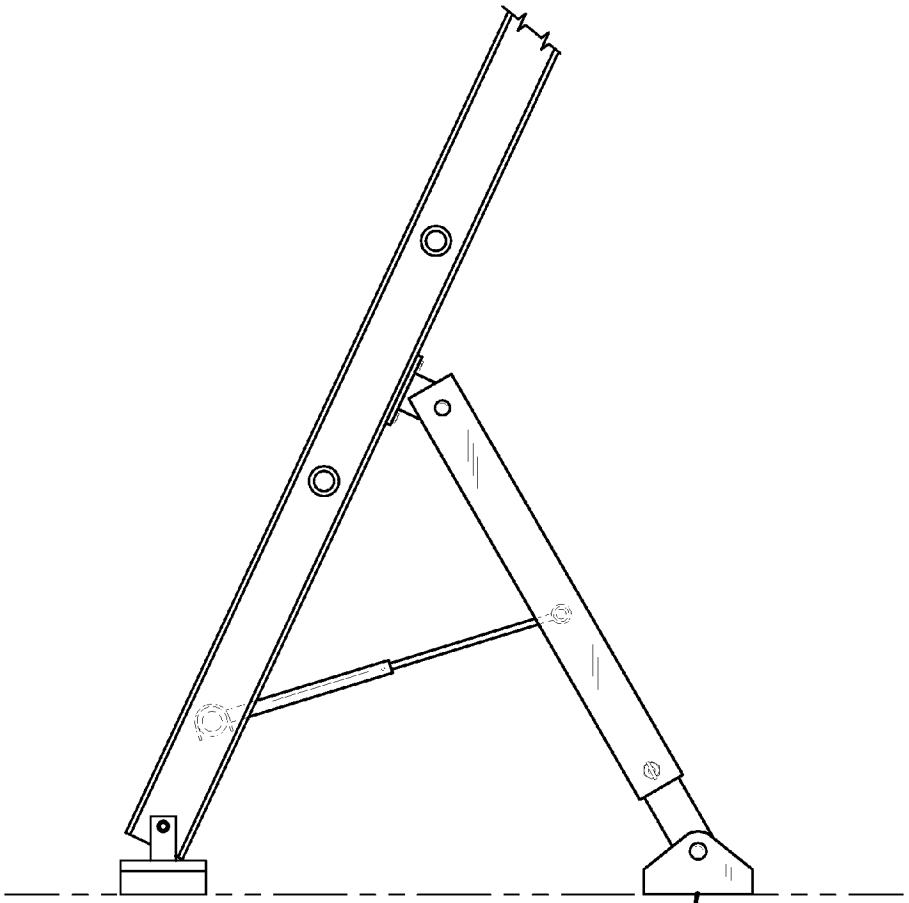
FIG. 5 is a side view of the device in use.

With reference now to the drawings, and in particular FIGS. 1 through 5 thereof, the instant stabilizer support for extension ladder employing the principles and concepts of the present stabilizer support for extension ladder and generally designated by the reference number 10 will be described.

Referring to FIGS. 1 through 5 a preferred embodiment of the present stabilizer support for extension ladder 10 is illustrated. The stabilizer support for extension ladder 10 includes a mirror image pair of hollow spring loaded parallel frame members 20, 22 having a first frame member 20 and a second frame member 22. Each respective frame member 20, 22 has an upper end 24, a lower end 26, and an inner wall 28. A slit 30 is disposed upon the upper end 24 of each frame member 20, 22.

A lateral support member 32 is medially disposed upon and longitudinally traversing between the inner wall 28 of each respective frame member 20, 22. The lateral support member 32 is therefore perpendicular to each frame member 20, 22. A pivot 34 is medially disposed upon the lateral support member 32 and is configured to rotate about a longitudinal axis of the lateral support member 32.

The present stabilizer support for extension ladder 10 also includes a spring loaded adjustable rung support 36 having a hollow cylinder 38 and a telescoping cylindrical extension member 40. The telescoping cylindrical extension member 40 is medially disposed upon the pivot 34. The cylindrical extension member 40 is telescopingly disposed within and engaged with the hollow cylinder 38. The hollow cylinder 38 has a proximal end 42 and a distal end 44. The rung support 36 is configured to extend upon an adjustment of the cylindrical extension member 40 within the hollow cylinder 38.

The present stabilizer support for extension ladder 10 also includes a plurality of adjustment mechanisms 46. Each of the plurality of adjustment mechanisms 46 have a welded nut 48 and a threaded member 50. Each of the threaded members 50 are configured to frictionally engage one of the of welded nuts 48. One of the plurality of adjustment mechanisms 46 is disposed upon the proximal end 42 of the hollow cylinder 38. The said adjustment mechanism 46 that is disposed upon the proximal end 42 of the hollow cylinder 38 is configured to reversibly secure the adjustment of the cylindrical extension member 40 within the hollow cylinder 38. A generally C-shaped rung engagement member 52 is disposed upon the distal end 44 of the hollow cylinder 38. The rung engagement member 52 is configured to frictionally fixedly engage a rung of a ladder.

The present stabilizer support for extension ladder 10 also includes a plurality of hinges 54. The apparatus also includes a mirror image pair of load bearing telescoping extension legs 56, 58 having a first extension leg 56 and a second extension leg 58. Each respective extension leg 56, 58 has a bottom end 60. One of the plurality of hinges 54 is disposed upon the bottom end 60 of each of the extension legs 56, 58. Each respective extension leg 56, 58 is slidingly engaged with one of the parallel frame members 20, 22 respectively, and is configured to adjust therein.

Additionally, at least one of the plurality of adjustment mechanisms 46 is disposed upon each of the respective frame members 20, 22. Each of the said adjustment mechanisms 46 that are disposed upon each of the frame members 20, 22 are configured to reversibly secure the adjustment of the respective extension leg 56, 58 within one of the respective frame members 20, 22.

The present stabilizer support for extension ladder 10 also includes a mirror image pair of adjustment feet including a first adjustment foot 62 and a second adjustment foot 64. Each of the respective adjustment feet 62, 64 are disposed upon one of the respective hinges 54 of the bottom end 60 of one of each of the extension legs 56, 58. Each of the adjustment feet 62, 64 is configured to angularly adjust about one of the hinges 54. Additionally, each adjustment foot 62, 64 has a non-skid frictional engagement surface 66 that is configured to maintain the respective adjustment foot 62, 64 in frictional alignment upon a surface.

The apparatus further includes a mirror image pair of mounting plates including a first mounting plate 68 and a second mounting plate 70. Each of the respective mounting plates 68, 70 have a mounting surface 72 and a hinging surface 74. One of the plurality of hinges 54 is disposed upon the upper end 24 of each of the frame members 20, 22. The hinging surface 74 of each of the respective mounting plates 68, 72 is disposed upon one of the respective hinges 54 of the upper end 24 of one of each of the frame members 20, 22. The hinging surface 74 of each of the mounting plates 68, 70 is configured to angularly adjust within the slit 30 of the upper end 24 of each of the respective frame members 20, 22. Therefore, the hinging surface 74 has a width of less than that of the slit 30, and the hinging surface 74 has a length sufficient enough to allow each of the mounting plates 68, 70 to adjust to an angle where the mounting surface 72 is at least parallel with the pair of frame members 20, 22.

At least one aperture 76 is disposed upon the mounting surface 72 of each of the mounting plates 68, 70. Each of the at least one aperture 76 is configured to reversibly secure a threaded member therethrough. Wherein, each of the mounting plates 68, 70 can be secured to a mounting member of a ladder by aligning the respective mounting plate 68, 70 with the mounting member of the ladder, threading a threaded member through the apertures 76 of each one of the mounting plates 68, 70 and the mounting surface, and securing the threaded member with a bolt.

A plurality of reinforcement baffles 78 are disposed within each of the telescoping extension legs 56, 58. The reinforcement baffles 78 are configured to reinforce the load bearing telescoping extension legs 56, 58 and evenly distribute a weight upon the telescoping extension legs 56, 58. Each of the spring loaded frame members 20, 22 are configured to bias each of the telescoping extension legs 56, 58 in an extended position, the length of which is determined by the users adjustment of one of the adjustment mechanism 46.

What is claimed is:

1. A stabilizer support for extension ladder comprising:

a mirror image pair of hollow parallel frame members having a first frame member and a second frame member, each frame member having an upper end, a lower end, and an inner wall;

a slit is disposed upon the upper end of each frame member;

a lateral support member medially disposed upon and longitudinally traversing between the inner wall of each frame member, the lateral support member perpendicular to each frame member;

a pivot medially disposed upon the lateral support member, the pivot configured to rotate about a longitudinal axis of the lateral support member;

an adjustable rung support having a hollow cylinder and a telescoping cylindrical extension member, the cylindrical extension member is medially disposed upon the pivot, the cylindrical extension member is also telescopingly disposed within and engaged with the hollow cylinder, the hollow cylinder has a proximal end and a distal end, the rung support is configured to extend upon an adjustment of the cylindrical extension member within the hollow cylinder;

a plurality of adjustment mechanisms, one of the plurality of adjustment mechanisms disposed upon the proximal end of the hollow cylinder, the adjustment mechanism disposed upon the proximal end of the hollow cylinder configured to reversibly secure the adjustment of the cylindrical extension member within the hollow cylinder;

a rung engagement member disposed upon the distal end of the hollow cylinder, the rung engagement member configured to frictionally fixedly engage a rung of a ladder;

a plurality of hinges;

a mirror image pair of load bearing telescoping extension legs, each extension leg having a bottom end; each respective extension leg slidingly engaged with one of the parallel frame members, each respective extension leg configured to adjust within one of the parallel frame members, one of the plurality of hinges disposed upon the bottom end of each of the extension legs;

at least one of the plurality of adjustment mechanisms disposed upon each of the respective frame members, each of the adjustment mechanisms disposed upon the frame members configured to reversibly secure the adjustment of the respective extension leg within the respective parallel frame member;

a mirror image pair of adjustment feet, each of the respective adjustment feet disposed upon the respective hinge of the bottom end of one of each of the extension legs, each of the adjustment feet configured to angularly adjust, each of the adjustment feet having a frictional engagement surface;

one of the plurality of hinges disposed upon the upper end of each of the frame members; and a mirror image pair of mounting plates, each of the mounting plates having a mounting surface and a hinging surface, the hinging surface of one of each of the respective mounting plates disposed upon the respective hinge of the upper end of one of each of the frame members, the hinging surface of each of the mounting plates configured to angularly adjust within the slit of the upper end of each of the respective frame members.

2. The stabilizer support for extension ladder of claim 1 further comprising:

at least one aperture disposed upon the mounting surface of each of the mounting plates, each of the at least one aperture configured to reversibly secure a threaded member therethrough.

3. The stabilizer support for extension ladder of claim 2 further comprising:

a plurality of reinforcement baffles disposed within each of the telescoping extension legs, the reinforcement baffles configured to reinforce the load bearing telescoping extension legs, the reinforcement baffles also configured to evenly distribute a weight upon the telescoping extension legs.

4. The stabilizer support for extension ladder of claim 3 wherein the rung engagement member is generally C-shaped.

5. The stabilizer support for extension ladder of claim 4 further comprising:

a plurality of welded nuts;

wherein each of the plurality of adjustment mechanisms is a threaded member, each of the threaded members configured to engage one of the plurality of welded nuts.

6. The stabilizer support for extension ladder of claim 5 wherein the adjustable rung support is spring loaded.

7. The stabilizer support for extension ladder of claim 6 wherein the each of the first frame member and the second frame member are spring loaded and configured to bias each of the telescoping extension legs in an extended position.

8. A stabilizer support for extension ladder comprising:

a mirror image pair of hollow spring loaded parallel frame members having a first frame member and a second frame member, each frame member having an upper end, a lower end, and an inner wall;

a slit is disposed upon the upper end of each frame member;

a lateral support member medially disposed upon and longitudinally traversing between the inner wall of each frame member, the lateral support member perpendicular to each frame member;

a pivot medially disposed upon the lateral support member, the pivot configured to rotate about a longitudinal axis of the lateral support member;

a spring loaded adjustable rung support having a hollow cylinder and a telescoping cylindrical extension member, the cylindrical extension member is medially disposed upon the pivot, the cylindrical extension member is also telescopingly disposed within and engaged with the hollow cylinder, the hollow cylinder has a proximal end and a distal end, the rung support is configured to extend upon an adjustment of the cylindrical extension member within the hollow cylinder;

a plurality of adjustment mechanisms, each of the plurality of adjustment mechanisms having a welded nut, and a threaded member, each of the threaded members configured to engage one of the of welded nuts, one of the plurality of adjustment mechanisms disposed upon the proximal end of the hollow cylinder, the adjustment mechanism disposed upon the proximal end of the hollow cylinder configured to reversibly secure the adjustment of the cylindrical extension member within the hollow cylinder;

a generally C-shaped rung engagement member disposed upon the distal end of the hollow cylinder, the rung engagement member configured to frictionally fixedly engage a rung of a ladder;

a plurality of hinges;

a mirror image pair of load bearing telescoping extension legs, each extension leg having a bottom end; each respective extension leg slidingly engaged with one of the parallel frame members, each respective extension leg configured to adjust within one of the parallel frame members, one of the plurality of hinges disposed upon the bottom end of each of the extension legs;

at least one of the plurality of adjustment mechanisms disposed upon each of the respective frame members, each of the adjustment mechanisms disposed upon the frame members configured to reversibly secure the adjustment of the respective extension leg within the respective parallel frame member;

a mirror image pair of adjustment feet, each of the respective adjustment feet disposed upon the respective hinge of the bottom end of one of each of the extension legs, each of the adjustment feet configured to angularly adjust, each of the adjustment feet having a frictional engagement surface;

one of the plurality of hinges disposed upon the upper end of each of the frame members;

a mirror image pair of mounting plates, each of the mounting plates having a mounting surface and a hinging surface, the hinging surface of one of each of the respective mounting plates disposed upon the respective hinge of the upper end of one of each of the frame members, the hinging surface of each of the mounting plates configured to angularly adjust within the slit of the upper end of each of the respective frame members;

at least one aperture disposed upon the mounting surface of each of the mounting plates, each of the at least one aperture configured to reversibly secure a threaded member therethrough; and a plurality of reinforcement baffles disposed within each of the telescoping extension legs, the reinforcement baffles configured to reinforce the load bearing telescoping extension legs, the reinforcement baffles also configured to evenly distribute a weight upon the telescoping extension legs;

wherein each of the frame members are configured to bias each of the telescoping extension legs in an extended position.

* * * * *